US006367965B1

(12) United States Patent
Kiu

(10) Patent No.: US 6,367,965 B1
(45) Date of Patent: Apr. 9, 2002

(54) INDICATING DEVICE FOR VARIOUS TYPES OF ROTATION ESCAPE REGULATOR

(76) Inventor: Taiyu Kiu, Shop 310 Worldwide Plaza, 19 Des Voeux Road, Central Hong Kong Special Administration Region (CN)

( * ) Notice: Subject to any disclaimer, the term of this patent is extended or adjusted under 35 U.S.C. 154(b) by 0 days.

(21) Appl. No.: 09/647,844

(22) PCT Filed: Mar. 31, 1999

(86) PCT No.: PCT/CN99/00042

§ 371 Date: Nov. 24, 2000

§ 102(e) Date: Nov. 24, 2000

(87) PCT Pub. No.: WO99/53383

PCT Pub. Date: Oct. 21, 1999

(30) Foreign Application Priority Data

Apr. 9, 1998 (CN) ..... 98101258

(51) Int. Cl.[7] ..... G04B 15/00; G04B 19/00
(52) U.S. Cl. ..... 368/127; 368/223
(58) Field of Search ..... 368/761, 124–128, 368/139–144, 223

(56) References Cited

U.S. PATENT DOCUMENTS 2,466,312 A * 4/1949 Heintz ..... 368/77
2,852,908 A * 9/1958 Stern et al. ..... 368/77
5,608,694 A 3/1997 Grimm et al. ..... 368/127

FOREIGN PATENT DOCUMENTS

| | | | |
|---|---|---|---|
| CN | 2192898 | Y | 3/1995 |
| CN | 2192899 | Y | 3/1995 |
| CN | 2192314 | Y | 5/1995 |
| CN | 2196314 | Y | 5/1995 |
| CN | 1113326 | A | 12/1995 |
| CN | 1115880 | A | 1/1996 |

* cited by examiner

*Primary Examiner*—Vit Miska
(74) *Attorney, Agent, or Firm*—Burns, Doane, Swecker & Mathis, L.L.P.

(57) ABSTRACT

An indicating means for use in many types of rotary escapement speed regulators, which comprises central balance wheel or eccentric balance wheel type rotary escapement speed regulator. The main characteristics is that, at the top of the rotary longitudinal concentric axle of the escape wheel pinion for the speed regulator is provided, in a mechanically connecting manner, with a means used for indicating the rotating condition. The configuration and material of the means may be selected in various manners. Through the indicating means, a user can directly watch the rotating condition and accurate time reading of the rotary escapement speed regulator. The integral structure of the indicating means of the present invention provides a miraculous and novel effect, which greatly enhances the timing accuracy and aesthetic effect of all the clocks and watches equipped therewith.

3 Claims, 3 Drawing Sheets

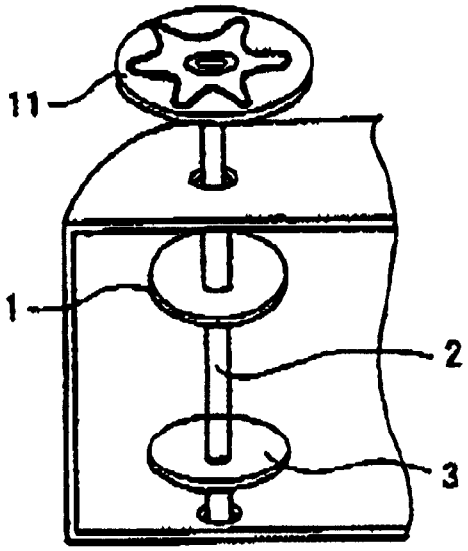
Figure 6
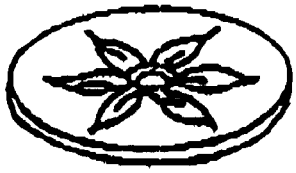
Figure 7a
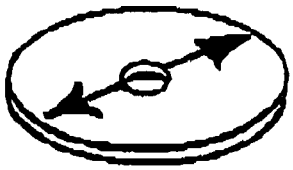
Figure 7b
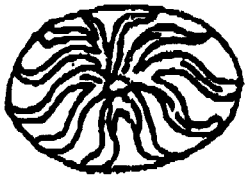
Figure 7c
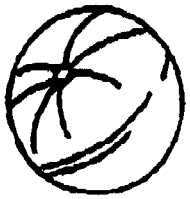
Figrue 7d

INDICATING DEVICE FOR VARIOUS TYPES OF ROTATION ESCAPE REGULATOR

FIELD OF THE INVENTION

The present invention belongs to the field of precision mechanical clocks and watches. Particularly relates to an indicating means for use in many types of rotary escapement speed regulators used in the precision mechanical clocks and watches.

DESCRIPTION OF THE PRIOR ART

Retracing the developing history of precision mechanical clocks and watches, it has been nearly two hundred years for people to utilize rotary escapement speed regulator to control the timing accuracy of the clocks and watches. As early as in 1801 when a Swiss invented a Tourbillon. After that, in 1930, a German invented a Flying Tourbillon. At latest, it is present inventor who invented a Jiao's Tourbillion in 1933. International clock and watch profession have affirmed the invention. The name of Jiao's Tourbillion has been appeared on several hundred books, yearbooks and textbooks related to clocks and watches. Concentrating on the research and development, the inventor has created a number of types of rotary escapement speed regulator lately. Since 1994 the patents being published and granted by China Patent Office are CN94240747.4 with title of invention "A rotary escapement speed regulator capable of continuously rotating 360°", CN94240793.8 with title of invention "A rotary escapement speed regulator without stationary upper support", and CN94109301.3 with title of invention "A rotary escapement speed regulator". These patents respectively record the characteristics, structures of different types of rotary escapement speed regulators, and demonstrate the progress and advantages as compared to the prior art. Due to the products designed by the inventor have the characteristics, such as, simple structure, less components, less weight, and less energy consumption, the stability, timing accuracy, and artistry of escapement speed regulator have been improved remarkably as compared to that of the prior art, which leads the clock and watch manufacture to a new stage.

Till now, these speed regulators are not provided with means that is able to indicate an accurate timing and running status. Apparently it is a difficult matter to install an indicating means on a component with very high accuracy. In order to provide the viewer with a possibility for directly viewing the rotating condition of the escapement part for the rotary escapement speed regulator and accurate time indication, and presenting a magic and mysterious sense in integral structure thereof, the inventor designs an indicating means that can be mounted in many types of rotary escapement speed regulators.

OBJECT OF THE INVENTION

The object of the invention is providing an indicating means for use in many types of rotary escapement speed regulators of the precision mechanical means, such as timepieces, like clocks and watches.

SUMMARY OF THE INVENTION

The object of present invention is accomplished through following technical solutions. According to the present invention, it is provided an indicating means for use in many types of rotary escapement speed regulator, which indicating means includes the type that is capable of being used in a central balance wheel or an eccentric balance wheel type rotary escapement speed regulators, characterized in that, a means for indicating the running condition of the speed regulator being mounted, in a mechanically connecting manner, at the top of a rotary longitudinal concentric axle of the escape wheel pinion for the speed regulator, the height of the position where the means is located can be flushed with or be higher or lower than that of the balance wheel of the escapement speed regulator. The indicating member can be of the shape of a disk, a sphere, a pattern of flat configuration or a pattern of stereo configuration and can be made of material including metal, nonmetal, organic transparent material or inorganic one either.

The manner of mechanical connection between the indicating means and the axle of the escapement wheel pinion can be of the kind of snap fitting of axle into hole, of precision screw jointing or of bonding with organic glue.

According to the present invention, the indicating means may not only have an effect of indicating accurate time reading, but also improve the level of static and dynamic balance of many types of assembly of rotary escapement speed regulator equipped with the indicating means of the present invention, such that advantageous effects in design and processing are brought forth. While enhancement of the timing accuracy of timepiece equipped with the indicating means of the present invention can be achieved, the aesthetic effect of the timepiece can also be enhanced.

Further, many types of rotary escapement speed regulators after being mounted with the indicating means of the present invention, in addition to that, the user can directly read the time reading through the indicating means, he can also clearly watch the condition of the rotary escapement speed regulator. Thus renders all the clocks equipped with the indicating means being enhanced not only in their time indicating accuracy, also greatly enhanced its aesthetic effect.

The embodiment of present invention will be further described with reference of the following drawings.

BRIEF DESCRIPTION OF THE FIGURES

FIG. 6 is a perspective view of the indicating means of the present invention for use in many types of rotary escapement speed regulators;

FIGS. 7*a* to 7*d* show the shapes of the effect indicating members of the rotation-condition indicating means respectively in the shapes of star type, pointer type, pattern type and sphere type.

DETAILED DESCRIPTION OF PREFERRED EMBODIMENT

Figure 1:
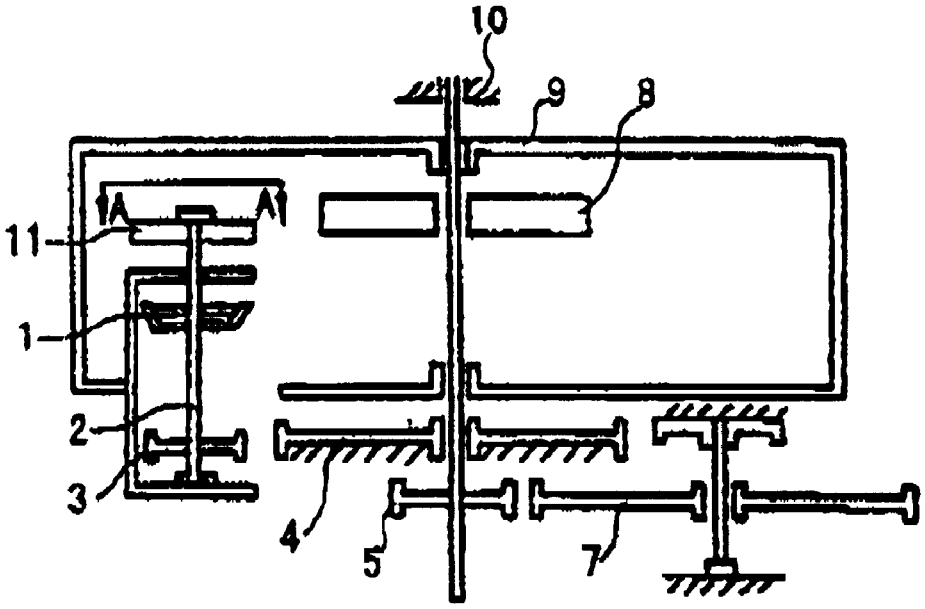
FIG. 1 shows a central balance wheel type rotary escapement speed regulator.
Figure 2:
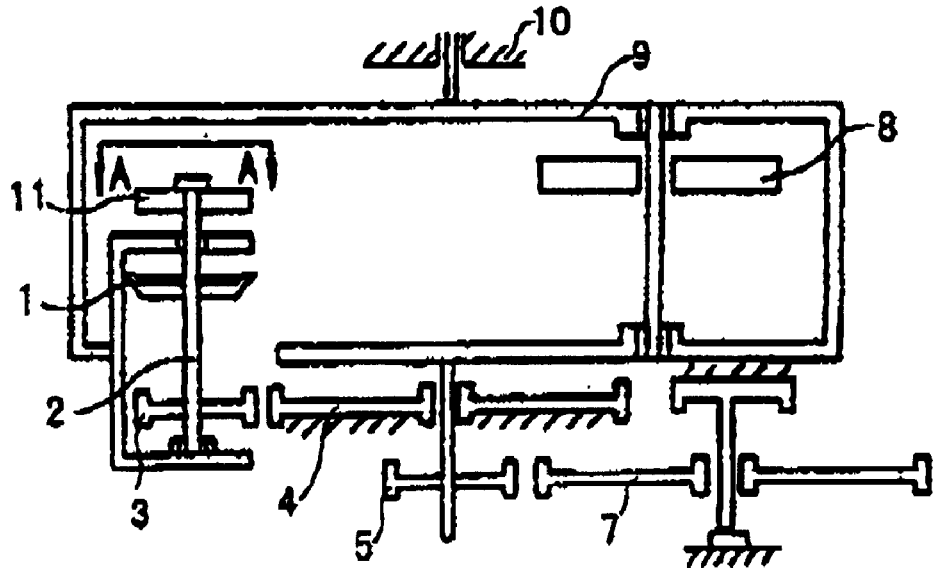
FIG. 2 shows an eccentric balance wheel type rotary escapement speed regulator.
Figure 3:
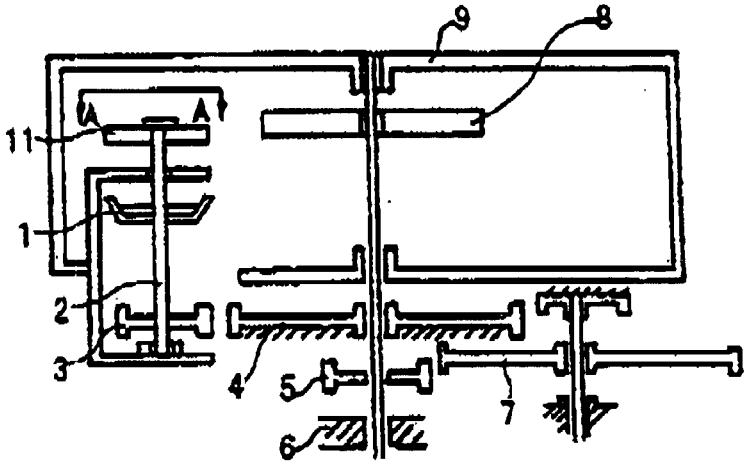
FIG. 3 shows a central balance wheel type rotary escapement speed regulator without static upper support.
Figure 4:
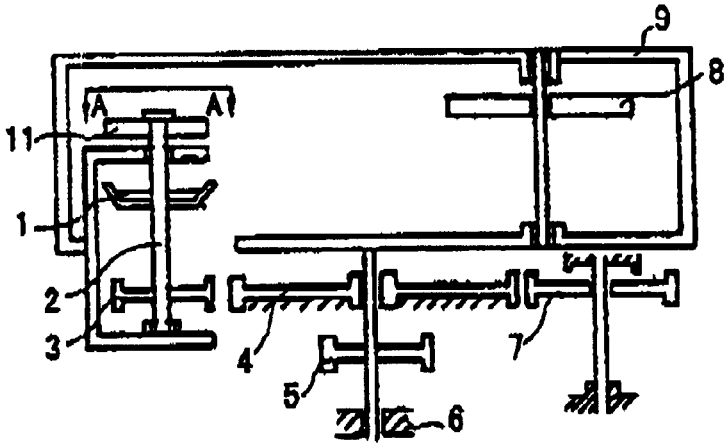
FIG. 4 shows an eccentric balance wheel type rotary escapement speed regulator without static upper support.
Figure 5:
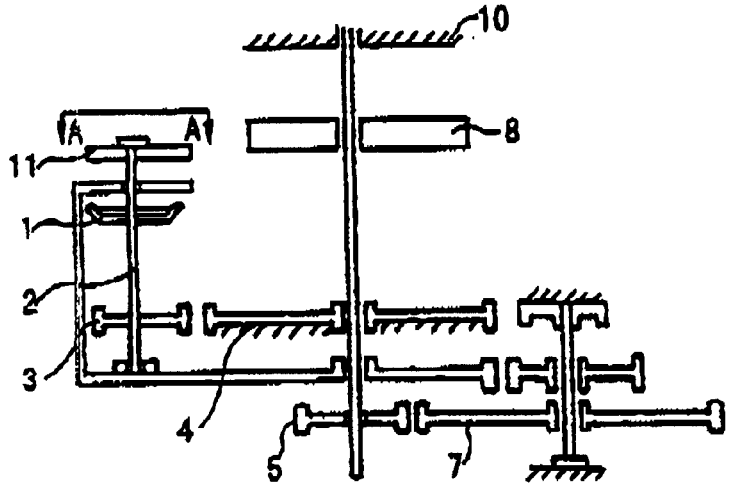
FIG. 5 shows an indicating means of a transparent central balance wheel type rotary escapement speed regulator not equipped with upper rotary frame, middle column of the rotary frame and other corresponding parts.

The indicating means of the present invention as that illustrated in FIG. 6 can be seen in FIGS. 1 to 5, wherein at the top of concentric axle 2, passing through an escape wheel 1 and the center of an escape wheel pinion 3, being provided with an indicating means 11, a static seconds wheel 4 engages with the escape wheel pinion 3, the axle 5 of the second wheel, which integrally joint to the rotary support 9, engages with a slave wheel 7. A balance wheel 8, the escape wheel 1 and an escapement lever are supported on the rotary support 9 which in turn is supported between a static support 10 and a main plate. As shown in FIG. 3, the rotary support 9 is supported between the fixed second wheel 4 and the main plate 6. The indicating means 11 is mounted on the top of the concentric axle 2 used in many types of rotary escapement speed regulators. Referring to FIG. 5, there is shown a rotary escapement speed regulator not equipped with upper rotary frame, middle column of rotary frame and other corresponding parts. FIG. 6 is a perspective view of the indicating means of the present invention for use in many types of rotary escapement speed regulators. The structure of the indicating means of the present invention can be more clearly seen from FIG. 6, wherein, an effect indicating member in the shape of a star, as one of embodiments, is mounted on the top of the indicating means. The indicating means may comprises different shapes of effect indicating members, such as, disk shape, sphere shape, pattern of flat configuration and a pattern of stereo configuration, as shown in FIG. 7*a* to 7*d,* which respectively show shapes of the embodiment for the effect indicating members of the rotating-condition indicating means that are interesting and novel, that is FIG. 7*a* is a multi-angle indicating effect part, FIG. 7*b* is a pointer indicating effect pan, FIG, 7*c* is a pattern type effect indicating member and FIG. 7*d* is a sphere type effect indicating member. In these embodiments indicating means is connected with the concentric axle by snap fitting of hole and axle, that is, the hole in an indicating disk or sphere being pressed onto the top of the axle 2, The materials used for making the indicating means can be of metal, nonmetal, or organic or inorganic transparent material.

What is claimed is:

1. An indicating means for use in many types of rotary escapement speed regulators, wherein at the top of a rotary longitudinal concentric axle of an escape wheel pinion for said rotary escapement speed regulator being provided, in a mechanical connecting manner, with a means used for indicating the rotating condition, the height where said means being located can be flush with, higher or lower than the height where a balance wheel of said rotary escapement speed regulator being located, said indicating means comprising an effect indicating member in the shape of a disk, a sphere, a pattern of flat configuration or a pattern of stereo configuration.

2. An indicating means as that claimed in claim 1, wherein the mechanically connecting manner of said indicating means with said axle of escape wheel pinion can be of the kind of snap fitting a hole and an axle, joining with precision screws or bonding with organic glue.

3. An indicating means as claimed in claim 1, wherein the material used for said indicating means can be of metal, nonmetal, or organic or inorganic transparent material.

* * * * *